United States Patent [19]

Mahn, Sr. et al.

[11] Patent Number: 4,610,904

[45] Date of Patent: Sep. 9, 1986

[54] HEAT ACTIVATED REMOVABLE ORNAMENTAL TRANSFER

[75] Inventors: John E. Mahn, Sr., 6154 Oak Haven Dr., Cincinnati, Ohio 45238; John E. Mahn, Jr., Cincinnati, Ohio

[73] Assignee: John E. Mahn, Sr., Cincinnati, Ohio

[21] Appl. No.: 680,360

[22] Filed: Dec. 11, 1984

[51] Int. Cl.[4] ..... B44C 1/16

[52] U.S. Cl. ..... 428/79; 156/240; 428/914

[58] Field of Search ..... 428/79, 914; 156/240

[56] References Cited

U.S. PATENT DOCUMENTS

| | | | |
|---|---|---|---|
| 3,255,695 | 6/1966 | Johnson et al. | 427/288 X |
| 3,359,127 | 12/1967 | Meyer et al. | 428/79 X |
| 3,379,592 | 4/1968 | Ostrowicz | 156/240 X |
| 3,554,836 | 1/1971 | Steindorf | 156/240 |
| 3,595,739 | 7/1971 | Meyer | 428/195 |
| 3,660,212 | 5/1972 | Liebe, Jr. | 428/41 |
| 3,920,499 | 11/1975 | Day et al. | 428/914 X |
| 3,922,435 | 11/1975 | Asnes | 156/240 X |
| 3,959,555 | 5/1976 | Day et al. | 428/914 X |
| 4,037,008 | 7/1977 | Tugwell | 156/240 X |
| 4,107,365 | 8/1978 | Reed et al. | 428/914 X |
| 4,246,315 | 1/1981 | Kopp et al. | 428/914 X |
| 4,256,795 | 3/1981 | Day et al. | 428/914 X |
| 4,269,885 | 5/1981 | Mahn | 428/216 |
| 4,390,387 | 6/1983 | Mahn | 428/90 |
| 4,466,994 | 8/1984 | Hubbard et al. | 427/56.1 |

*Primary Examiner*—Henry F. Epstein

*Attorney, Agent, or Firm*—Wood, Herron & Evans

[57] ABSTRACT

A heat activated decorative includes a lower thermoplastic layer and an upper layer which is a thermoset ink. The decorative is suitable for use on clothing which is laundered in industrial laundries wherein the wash cycle subjects the garments to pHs greater than 10 and the dryer subjects the garments to ambient temperatures of 400° F. and momentary contact with the dryer drum wall which is about 500° F. The lower thermoplastic layer is a high melt thermoplastic having a melting point of at least about 380° F. and the upper layer is a thermoset ink which has a thickness effective to protect the thermoplastic layer from the effects of the industrial laundry and specifically about 25 microns in thickness or more. The decoratives of the present invention can be in the form of machine readable bar codes to provide a method of sorting rented garments.

10 Claims, 7 Drawing Figures

HEAT ACTIVATED REMOVABLE ORNAMENTAL TRANSFER

BACKGROUND OF THE INVENTION

Ornamental transfers and indicia presenting heat activated decoratives are well known and are typically applied to cloth and other substrates, particularly clothing. These decoratives, particularly heat activated decoratives, are used to provide numbers on sports jerseys, names on shirts and company logos on uniforms. There are several types of heat activated decoratives. Many decoratives include a hot melt adhesive as a layer which is bonded to the cloth surface. The upper layer can be made from a variety of different materials. These are applied to a substrate by heat, pressure and time sufficient to melt the hot melt adhesive layer and permit penetration of the melted adhesive into the surface of the garment. Other decoratives are formed from thermosetting resins which are cured as they are applied to the substrate.

In most applications, these decoratives do not need to be removed by solvent or heat. Therefore, thermoset decoratives are quite acceptable. Further in most applications the decoratives need only withstand temperatures up to about 140° F. These are the temperatures typically encountered in home dryers. Known decoratives generally hold up well when subjected to such temperatures as well as the alkaline condition of a normal washing.

Prior art decoratives which can withstand the condition of home laundries are never suitable for application onto rental uniforms. Rental uniforms are washed in industrial laundry facilities or hospital laundry facilities. Industrial and hospital laundry facilities use high temperature dryers wherein the ambient temperature of the interior of the dryer reaches at least about 300°–400° F. and the wall of the dryer reaches about 500° F. Commercial laundries also use extremely alkaline wash water which is heated to about 200° to about 212° F.

Further, any indicia on a rental uniform must be removable or else that uniform is relegated to permanent use. For example, if a uniform is permanently marked with—Bill—it is relegated for permanent use by someone named Bill. This would require a prohibitive amount of inventory.

Because of the extreme conditions which a garment is subjected to in an industrial laundry and because the indicia or transfer must be removable, uniform rental companies have resorted to embroidered patches to provide names and other logos for rental uniforms. The embroidered patches are sewn onto the garment or may be heat sealed using a hot melt adhesive. The outer surface of the patch of course is cloth that can withstand the high temperature of the dryer even the drum wall. The embroidered patch can be removed from the garment by either cutting the stitches or dissolving the hot melt adhesive in an appropriate solvent. Embroidered patches are attractive but are stiff and can cause discomfort to the wearer of the garment. Further, embroidered patches are substantially more expensive than laminated, heat activated decoratives.

Heat activated decoratives and transfers commonly used in non-commercial applications are not removable or cannot withstand the high temperatures of a commercial laundry or the high alkalinity of the commercial laundry. Many such heat activated transfers upon striking the drum of the dryer will partially melt and smear onto adjacent garments. Some transfers are dissolved by the activity of either the alkaline washing or of a dry cleaning fluid. Transfers with a polyvinyl chloride thermoplastic layer when subjected to a solvent will dissolve and migrate into the cloth itself thus permanently marring the garment.

Such a transfer is disclosed by Liebe, Jr. U.S. Pat. No. 3,660,212. Liebe discloses a heat activated transfer formed from a polyvinyl chloride lower layer and a surface layer of a cross-linked polyvinyl chloride plastisol. The plastisol is highly pigmented and acts as an ink. This decorative transfer cannot be removed and cannot withstand the high temperatures of a commercial dryer.

Another decorative is disclosed in Mahn U.S. Pat. No. 4,390,387. This patent discloses a flocked decorative with a lower thermoplastic layer with an upper flock layer bonded to a thermoset layer. But the thermoplastic layer cannot withstand the high temperatures of a commercial dryer. Further, the thermoset layer is an acrylic and cannot withstand the strong alkaline condition of a commercial laundry.

SUMMARY OF THE INVENTION

The present invention is premised upon a realization that a heat-sealed decorative which can withstand the high pH as well as the high temperatures of commercial laundry facilities and can further be removed with an appropriate solvent without marring the garment can be formed from a high temperature hot melt adhesive as the lower layer and an upper layer which is a film of a highly cross-linked thermoset film bearing indicia. The film, preferably a thermoset ink, is thick enough to protect the thermoplastic layer from the high temperature conditions of an industrial dryer and itself is not damaged by these high temperatures since it is a thermoset. The thermoset resin is selected from resins which are not hydrolyzed by strong alkaline solutions.

The invention will be further appreciated in light of the following detailed description and figures in which:

DETAILED DESCRIPTION OF THE INVENTION

Figure 1:
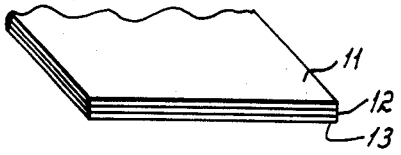
FIG. 1 is a perspective view partially broken away of a laminate in accordance with the present invention.

A heat activated decorative to be useful on clothing subjected to industrial or hospital laundries must be capable of withstanding washing under highly alkaline conditions, for example, with pH's of 10 or 11 and even higher, and must be capable of withstanding extremely high temperatures encountered in dryers. Industrial and hospital laundry facilities typically dry clothing at temperatures of 400° F. with the surface of the drum reaching 500° F.

According to the present invention, a decorative which can withstand these harsh conditions is a two component system. The two component system includes an upper layer or film of a non-hydrolyzable thermoset film bearing indicia and preferably a polymeric ink. The present indicia for the decorative which is bonded to a lower film of a high temperature non-hydrolyzable thermoplastic layer. The thermoplastic layer is intended to be heat bonded to a cloth substrate such as a shirt. The upper layer which is intended to face away from the cloth substrate has a thickness effective to prevent the thermoplastic layer from flowing or melting even though the decorative may be momentarily (i.e., 1–2 seconds) subjected to temperatures of 500° F. when contacting the drum of a dryer or 400° F. internal dryer conditions.

A thermoset plastic is a resin which in its final state is substantially infusible and insoluble. Thermosetting resins, often liquids at some state in their manufacture or process, are cured by heat, catalysis or other chemical means. After being fully cured thermosets cannot be resoftened by heat. Thermosets include those plastics which are normally thermoplastic but which are made thermosetting by means of cross-linking with other materials such as cross linked polyolefins. Thermosets do not include plastisols which are a suspension of finally divided vinyl chloride polymer or copolymer in a liquid plasticizer which dissolves the resin when heated. Plastisols by some definitions are considered to be thermosetting in that they harden when heated. However, these compounds remains thermoplastic once solidified and accordingly are not included within the term thermoset.

The upper layer is a film of a non-hydrolyzable thermoset resin containing indicia. It must be able to withstand a high temperature laundering. Specifically, it must not be hydrolyzed by aqueous alkaline solutions having a pH of about 10 and more preferably 11 at temperatures ranging from about 200° to about 212° F. for 30 to 45 minutes. Hydrolysis specifically refers to a chemical reaction in which water reacts with another substance to form one or more new substances. Generally polymers which are not hydrolyzable under alkaline conditions are thermoset polyamides, thermoset polyurethanes, thermoset polyolefins, thermoset polyepoxides, and thermoset polyesters. Other polymers, of course, can be formulated so that they are non-hydrolyzable at high pHs by controlling the cross-linking.

To determine if a polymeric ink is substantially not hydrolyzed by an aqueous solution having a pH of at least about 10, a film of the polymeric ink is added to an aqueous solution having a pH of at least about 10 and agitated for 10 minutes at room temperature. If the solution is visibly discolored, the polymeric ink is hydrolyzable and unsuitable for use in the present invention.

The upper layer also is characterized in that it is an ink or in a less preferred embodiment a clear coating covering an ink. In the present invention, ink refers to a resin including a sufficient concentration of pigment and carrier to provide a stable dispersion of pigment and in an amount effective to provide a desired color. Suitable pigments and carriers are well known to those of ordinary skill in the art. Typically a carrier would be clay or an amorphous polymer and the pigment will vary depending on the color of the ink.

Further in the present invention, the thermoset non-hydrolyzable ink must not decompose at temperatures below 500° F. In high temperature industrial laundry facilities the drying activity will frequently subject the upper surface momentarily to temperatures of about 500° F. Therefore it is critical that the polymer not decompose at these temperatures.

As stated there are many different types of polymers which would be suitable for use in the present invention. One particular polymer particularly useful as a thermoset non-hydrolyzable ink is a moisture cured polyurethane ink. The moisture cured polyurethanes are isocyanate terminated polymers. Curing takes place by the reaction of free isocyanate with atmospheric moisture. Isocyanate terminated polymers can be prepared by the reaction of polyethers or polyesters with di-isocyanate or the reaction of diols, triols, and tetraols with di-isocyanate. With increasing cross-linking density these polymers provide better chemical and solvent resistance of the cured film while decreasing flexibility. Accordingly, a balance of chemical and solvent resistance with flexibility is desired but is simply a matter of preference.

These moisture cure polyurethanes particularly suitable for use in the present invention because they are not affected by aqueous solutions having a pH of 12 and are not affected by water when immersed at 25° for 24 hours.

Specific moisture cure polyurethane inks useful in the present invention are presented in the following examples.

EXAMPLE 1

White Ink

A white ink suitable for use in the present invention is prepared by simply mixing the following components:

26.5% Zephrylon 55515 clear polyurethane varnish
12.8% Zephrylon K-45500 moisture cure polyurethane catalyst
60.7% Zephrylon K-70126 white pigmented polyurethane All of these products are produced and sold by the Sinclair and Valentine Chemical Coatings Group of Wheelabrator-Frye Inc. of North Kansas City, MO. In this example polyurethane varnish is added to make the ink non-hydrolyzable at higher pHs, i.e., about 11. This is required because the white ink is so heavily loaded with pigment and carrier.

EXAMPLE 2

Red Ink

A red ink was formulated from the following components:

20% Zephrylon K-45500 moisture cure polyurethane catalyst
80% Zephrylon K-57271 red pigmented polyurethane

EXAMPLE 3

Black Ink

A black ink was formulated from the following components:

20% Zephrylon K-45500 moisture cure polyurethane catalyst
80% Zephrylon K-55716 black pigmented polyurethane

EXAMPLE 4

Blue Ink

A blue ink was formulated from the following components:

20% Zephrylon K-45500 moisture cure polyurethane catalyst

80% Zephrylon K-57278 blue pigmented polyurethane

In the above examples the polyurethane catalyst is simply a moisture cure polyurethane with a high proportion of reactive isocyanate groups. The pigmented polyurethane is also a moisture cure polyurethane with a lower relative amount of the isocyanates.

The lower thermoplastic layer is a thermoplastic polymer having a high melting point preferably one which does not flow at less than about 350° F. and preferably 400° F. Further the thermoplastic must be one which can be easily removed from a garment either by heat or solvent. Suitable solvent removable thermoplastics include polyesters, polyamides, polyurethanes and polyethers. High melt polyurethanes are preferred and can be removed with dimethylformamide as well as cyclohexanol. Polymers such as polyvinyl chloride are not easily removed by solvent since they tend to totally dissolve in the solvent and sink into the garment permanently marring the garment.

One adhesive particularly suitable for the present invention is a polyurethane thermoplastic made by the K. J. Quinn Co. in Malden, MA product PS-27. This product has a Shore A hardness of 85-90, a Shore D hardess of 35-40, and a melting temperature of 400°-420° F.

The thermoplastic layer must be compatible with the thermoset layer so separating or delamination does not occur upon application. Therefore it may be preferable to employ the same class of polymer for the thermoplastic and thermoset layers. Preferably when the upper layer is a thermoset polyurethane ink the lower thermoplastic layer should be a high melt polyurethane thermoplastic adhesive.

In the present invention, the thermoset ink layer must be thick enough to protect the thermoplastic layer from the heat of the dryer. To protect a thermoplastic layer having a melting or flowing point of 400° F., the thermoset layer must be at least 25 microns thick and more preferably at least about 40 microns. This will protect a decorative which is subjected to an industrial dryer. In other words, when the upper thermoset ink layer contacts or rests on a surface which is about 500° F. for 1-2 seconds the thermoplastic layer will not flow or melt. This presumes that the decorative is not pressed against the heated surface but simply rests on the heated surface.

Although the present invention can be provided in several different embodiments one preferred embodiment comprises an upper exposed layer of a thermoset polyurethane moisture cure ink having a film thickness of at least about 40 microns and preferably about 125 microns to 4 mils. The lower layer is a thermoplastic polyurethane having a melting point of at least about 400° F. and being at least about 2 mils thick. The thermoset ink provides the indicia and covers the lower thermoplastic layer so that there is little or no exposed surface of the thermoplastic layer once applied to a garment.

In the present invention there is no need for an upper protective layer since heat can be applied directly to the thermoset ink to melt the lower thermoplastic layer and adhere it to a cloth substrate. This decorative can be transferred to a cloth article by application of 385° F. for 4 seconds with a minimum pressure of about 4 psi.

The present invention can be further appreciated by reference to the drawings which show different embodiments of the present invention.

With reference to FIG. 1, there is shown a three layer laminate. This laminate includes an upper layer 11 which is a continuous film of a thermoset ink, a second layer 12 which is a clear thermoplastic adhesive layer and a lowest layer 13 which is a removable release coated sheet. To manufacture this laminate the thermoplastic layer 12 is extruded onto the release coated sheet 13. The upper thermoset ink layer is then roll coated onto the thermoplastic layer 12. Prior to application to a substrate the lower release coated layer 13 is simply pulled from the thermoplastic layer 12. The laminate is applied to a garment with thermoplastic layer 12 facing the garment. Heat and pressure are applied directly to the thermoset layer 11.

Figure 1A:
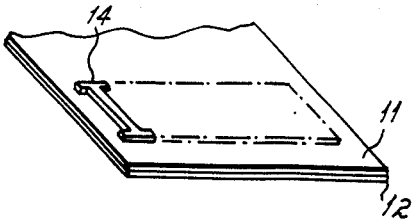
FIG. 1*a* is a perspective view partially broken away of a modification of the embodiment shown in FIG. 1.

As shown in FIG. 1*a*, the two component system can be further modified by printing additional layers of thermoset ink onto the upper continuous layer 11. As shown in FIG. 1*a* there is a lower layer 12 of thermoplastic adhesive. The upper layer is a continuous layer 11 of a white thermoset ink as disclosed in Example 1. Once cured a second layer of red thermoset ink 14 as disclosed in Example 2 is printed or screened onto layer 11. Layer 14 is allowed to air cure and the laminate is applied to a cloth substrate by simply placing layer 12 upon the cloth substrate and applying heat and pressure against the upper layers 14 and 11. The heat transfers through the upper layers to thermoplastic layer 12 causing it to melt and permanently adhere to the garment without feathering.

Figure 1B:
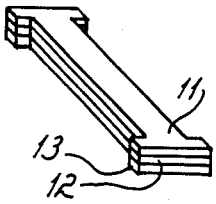
FIG. 1*b* is a perspective view of a modification of the embodiment shown in FIG. 1.

An alternate method of providing indicia with the present invention is shown in FIG. 1*b*. FIG. 1*b* is a modification of the embodiment of FIG. 1. In this embodiment the solid laminated sheet shown in FIG. 1 is simply cut using a water knife or other suitable means to form the shape of indicia such as letters or logos.

Figure 1C:
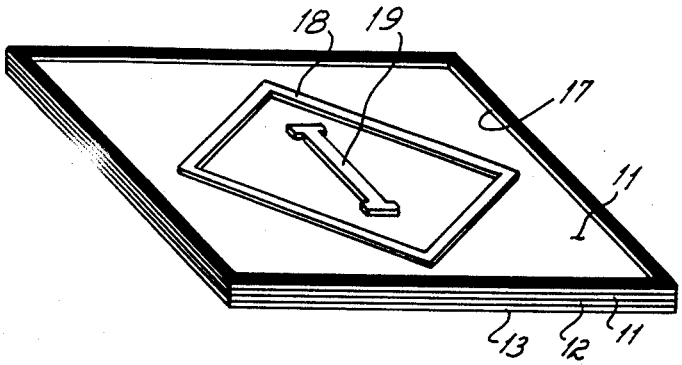
FIG. 1*c* is a perspective view of an alternate embodiment of the invention shown in FIG. 1.

FIG. 1*c* shows an alternate embodiment providing indicia. The decorative shown in FIG. 1*c* includes release sheet 13 coated with extruded thermoplastic layer 12 and roll coated with upper layer 11 of a thermoset ink. The uppermost layer 11 is a 100 micron thick film of a white thermoset polyurethane ink of the formulation of Example 1. This is again simply roll coated onto layer 12 and allowed to dry and set. Once set layer 12 is printed with additional indicia. As shown in FIG. 1*c*, printed onto layer 11 is a black border 17 which is approximately 70 microns thick formed from the coating composition of Example 3. Within the black border area and again printed on layer 11 is a blue diamond 18 again screen printed onto layer 11. The blue diamond 18 is a thermoset polyurethane ink made in accordance with the formula disclosed in Example 4 and provided in a film thickness of about 90 microns. Finally in the center of the blue diamond 18 is indicia 19. The indicia is provided by a 70 micron thick coating of a red thermoset polyurethane ink having the formula disclosed in Example 5. Again this is screen printed onto the white layer 11. If need butylcellusolveacetate can be used to thin the thermoset ink to obtain a desired viscosity.

Figure 2:
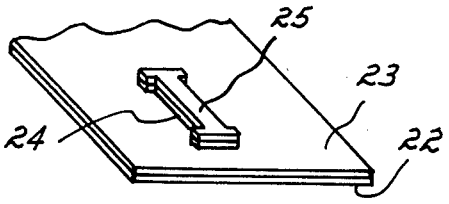
FIG. 2 is a perspective view partially broken away of an alternate embodiment of the present invention.

FIG. 2 shows a substantially different method of providing a decorative heat activated transfer of the present invention. In this application the decorative is provided on a release sheet 22 preferably formed from polyethyleneterepthalate having a very high melting point. The polyethyleneterepthalate has a silicone coating 23 which permits removal of the decorative from the release sheet.

Screened onto the silicone layer 23 is a thermoset polymer ink layer 24 which is reversed printed showing indicia. This is allowed to air cure. Above this cured thermoset layer 24 is a thermoplastic layer 25 which is a high melt thermoplastic adhesive. The high melt thermoplastic adhesive is screen printed over the ink layer 24 from a solution of the thermoplastic dissolved in an appropriate solvent such as cyclohexanol. This is screened onto the indicia 24 and the cyclohexanol is allowed to evaporate providing a thermoplastic layer only over the indicia.

This is applied to a cloth substrate by pressing the thermoplastic layer 25 against the cloth substrate and applying heat from above the polyethyleneterepthalate layer 22. Heat migrates through the polyethyleneterepthalate through the silicone and the thermoset layer 24 to the thermoplastic layer 25 causing it to melt and migrate into the cloth. Once cooled this provides a good bond for the indicia. Since the polyethyleneterepthalate is coated with a silicone layer it can be separated from the thermoset layer 24 by simply pulling it away from the thermoset layer 24 once the thermoplastic layer is adhered to the cloth.

Figure 3:
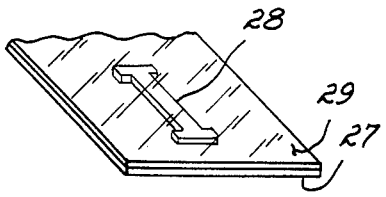
FIG. 3 is a perspective view partially broken away of an alternate embodiment of the present invention.

The embodiment shown in FIG. 3 includes a lower layer 27 which is an extruded high melt polyurethane thermoplastic adhesive. Printed on the thermoplastic adhesive 27 is indicia 28 provided by a polymeric ink. The polymeric ink useful in this embodiment is not critical. The indicia 28 is then coated with a clear layer of a thermoset polymer preferably a thermoset polyurethane. This clear layer 29 protects the indicia from the harsh action of the washing solution. This is a less preferred embodiment of the present invention.

The decorative described in the preceding examples are not effected by a dry cleaning fluid and have an indefinite shelf life. The decoratives shown in FIGS. 1, 1*a*, 1*b*, 1*c* and 3 (and FIG. 4 described later) are all applied without the aid of a protective outer covering. Therefore the decorative can be viewed during application. The heat is applied directly to the upper thermoset layer. This provides for easier application with more accurate location of the decoratives. A further advantage of the present invention is that a hot iron can be directly applied to the decorative without effecting the decorative. Thus, a garment can be easily ironed.

Since the upper layer is cross-linked when the decorative is manufactured, these decoratives are also extremely stable and have an indefinite shelf life.

Any of the indicia as shown in FIGS. 1–3 can be easily removed by activity of a solvent or by application of heat. Because the lower layer is a thermoplastic it can be reheated to soften the thermoplastic layer and the decorative can be removed. Preferably a heated blade having a temperature high enough to melt the thermoplastic layer but not so hot as to scorch the cloth layer is used to remove the decorative. More preferably the decorative and cloth are soaked in an appropriate solvent which will soften the thermoplastic layer and allow the thermoset and thermoplastic layer to simply be pulled off. Typically polyesters can be removed with methylenechloride. Polyamides are removable using chloroform. Polyurethanes can be removed by soaking the decorative in either dimethylformamide or cyclohexanol. Likewise polyethers can be removed by dimethylformamide. This high melt thermoplastic can be removed by these solvents without causing the thermoplastic to migrate into the cloth.

The indicia of the present invention accordingly can be thermoplastically adhered to a cloth substrate such as a garment for example a shirt. These can be washed under highly alkaline conditions wherein the pH is at least 10 or 11, and dried in industrial dryers and ironed at least 50 times. The thermoplastic layer is protected from the momentary contacts with the drum surface of the dryer by the thermoset layer. This prevents the decorative from moving and coming off the garment in the dryer. The thermoset layer is not effected by the high temperature of the dryer.

Further, the thermoplastic layer permits the entire decorative to be removed from a garment with a solvent. Thus, using the present invention the garment is only temporarily marked with the decorative. This provides a unique method of marking garments used as rental uniforms and the like.

Figure 4:
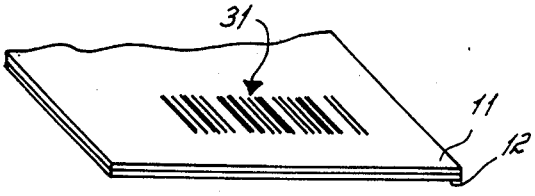
FIG. 4 is a perspective view partially broken away of a decorative according to the present invention having indicia which is a machine readable bar code.

The present invention provides a unique method of sorting garments for a uniform rental company. As shown in FIG. 4 a decorative can be provided according to the present invention with a lower layer of high temperature, thermoplastic adhesive and an upper layer of a thermosetting ink wherein the indicia provided by the thermoset ink establishes a bar code. This is thermoplastically adhered to the surface of a garment. As shown in FIG. 4 the upper layer includes a solid background 11 of a white thermoset ink made according to Example 1 covering a thermoplastic layer 12. An uppermost ink layer in the form of a parallel bars 31 providing a machine readable bar code is printed onto layer 11 and provides a means to code each garment. The bar code is stored in a computer and is assigned a particular meaning.

According to the system, an article of clothing would have a decorative as shown in FIG. 4 including a bar code thermoplastically adhered to the article of clothing. Normal laundering of the article would not cause the bar code to be removed. Thus, when the uniform rental company rented a garment marked with such a decorative it could be laundered and subsequently sorted solely by means of the bar code. The bar code with its computer assigned meaning could indicate the company renting the uniform and the individual using the uniform and any additional information necessary to get the garment to its assigned location.

Since the decorative shown in article 4 is removable by solvent and/or heat, the bar code indicia could be removed when that article of clothing was no longer being rented by the same company or was no longer being used by the same individual. Subsequently a new bar code could be provided which would be coded to indicate a different individual. Alternately, since bar codes are machine readable and their meaning is established in a computer, the old bar codes could be left on the article and simply have that bar code assigned a different meaning. Thus, the need to remove the bar code would be eliminated.

Thus having described our invention and some of its intended uses, we claim:

1. A decorative transfer comprising:

a lower layer adapted to be thermoplastically adhered to a cloth substrate;

an upper indicia bearing layer overlying and bonded to said lower layer;

said lower layer comprising a high melt, thermoplastic adhesive composition;

said upper layer comprising a thermoset film containing said indicia having a film thickness effective to prevent separation of said thermoplastic layer from said cloth during high temperature laundering and wherein said layers are substantially non-hydrolyzable by an aqueous washing solution having a pH of at least about 10.

2. decorative transfer claimed in claim 1, wherein said thermoset film is a thermoset ink having a film thickness of at least about 25 microns and less than about 4 mils.

3. The decorative transfer claimed in claim 2, wherein said thermoset film is a thermoset ink selected from the group consisting of thermoset polyurethane inks, thermoset polyolefin inks, thermoset polyamide inks, polyester inks, and thermoset polyepoxide inks.

4. The decorative transfer claimed in claim 3, wherein said thermoset ink comprises a moisture cure polyurethane ink comprising a moisture cure polyurethane resin in combination with a pigment and a carrier, said polyurethane being present in an amount effective to prevent said polyurethane ink from being hydrolyzed by an aqueous solution having a pH of at least about 11.

5. The decorative transfer claimed in claim 3, wherein said thermoplastic layer comprises a thermoplastic resin selected from the group consisting of thermoplastic polyurethane, thermoplastic polyamide, and thermoplastic polyester.

6. The decorative transfer claimed in claim 5, wherein said thermoplastic layer is a thermoplastic adhesive comprising a high melt polyurethane having a melting point of at least about 400° F.

7. The decorative transfer claimed in claim 6, wherein said thermoplastic layer comprises a high melt thermoplastic polyurethane having a melting point of at least about 420° F.

8. A decorative transfer having an upper layer and a lower layer bonded together and adapted to be bonded to a cloth substrate, said lower layer comprising a high melt polyurethane thermoplastic adhesive having a melting point of at least about 400° F., said upper layer comprising a film of thermoset polymeric ink having a film thickness effective to prevent said thermoplastic layer from melting when said upper layer momentarily contacts a surface having a temperature of up to about 500° F., said film thickness being at least about 25 microns and wherein said thermoset ink comprises a moisture cured polyurethane ink.

9. A decorative transfer comprising a high temperature thermoplastic layer having a melting point of at least about 380° F.;

a polymeric ink printed onto said high temperature thermoplastic layer to provide indicia;

an uppermost layer comprising a clear, cured, thermoset resin film completely covering said polymeric ink and said thermoplastic layer, said film having a thickness effective to prevent said thermoplastic layer from melting when said thermoplastic layer momentarily contacts a surface having a temperature up to about 500° F., said film thickness being at least about 25 microns;

said thermoset resin comprising a resin which is substantially not hydrolyzed by an aqueous solution having a pH up to about 10.

10. A method of applying the decorative transfer claimed in claim 1 to a cloth substrate, comprising:

positioning said thermoplastic layer directly on said cloth substrate and applying heat and pressure directly against said thermoset layer to cause said thermoplastic layer to soften and adhere to said cloth substrate.

* * * * *